US006980628B2

(12) United States Patent
Wang et al.

(10) Patent No.: US 6,980,628 B2
(45) Date of Patent: Dec. 27, 2005

(54) ELECTRON COLLECTOR SYSTEM

(75) Inventors: Liqin Wang, Brookfield, WI (US); Michael Scott Hebert, Muskego, WI (US); Mark Derakhshan, Brookfield, WI (US); Ron Kent Hockersmith, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/708,918

(22) Filed: Mar. 31, 2004

(65) Prior Publication Data

US 2005/0226386 A1 Oct. 13, 2005

(51) Int. Cl.[7] ..... H01J 35/18
(52) U.S. Cl. ..... 378/140; 378/119; 378/137
(58) Field of Search ..... 378/119, 121, 123, 378/127, 128, 130, 199, 140–142, 200, 203, 378/136, 137

(56) References Cited

U.S. PATENT DOCUMENTS 4,731,804 A * 3/1988 Jenkins ..... 378/140
5,535,255 A * 7/1996 Gabbay ..... 378/200
5,689,542 A * 11/1997 Lavering et al. ..... 378/142
6,215,852 B1 * 4/2001 Rogers et al. ..... 378/142
6,301,332 B1 * 10/2001 Rogers et al. ..... 378/142
6,714,626 B1 3/2004 Subraya

* cited by examiner

*Primary Examiner*—Edward J. Glick
*Assistant Examiner*—Elizabeth Keaney

(57) ABSTRACT

A slotted window collector assembly for an x-ray tube having an anode and a cathode includes a collector having an anode side and a cathode side, which opposes the anode side. The anode side and the cathode side define an internal bore there between for receiving x-rays from the anode. The slotted collector further includes a window side common to both the anode side and the cathode side and having a window coupled thereto, wherein a window aperture is defined extending from the window to the internal bore. Within the collector assembly, a slot is defined intersecting the window aperture and extending trans-axially thereto and beyond a set length. The slot also extends circumferentially with the window such that plastic strain on the window and heat transferred to the window are reduced.

19 Claims, 2 Drawing Sheets

ELECTRON COLLECTOR SYSTEM

BACKGROUND OF INVENTION

The present invention relates generally to thermal energy management systems within electron beam generating devices and, more particularly, to an assembly for cooling and relieving stress from an x-ray tube window.

There is a continuous effort to increase x-ray imaging system scanning capabilities. This is especially true in computed tomography (CT) imaging systems. Customers desire the ability to increase the peak power to reduce X-ray doses. The increase in peak power also allows physicians to get improved CT images of vascular applications with high speed CT imaging systems. Although the increase in imaging speed generates improved imaging capability, it causes new constraints and requirements for the functionality of the CT imaging systems.

CT imaging systems include a gantry rotating at various speeds in order to generate a 360° image. The gantry includes an x-ray tube, which composes a large portion of the rotating gantry mass. The CT tube generates x-rays across a vacuum gap between a cathode and an anode. For generating the x-rays, a large voltage potential is applied across the vacuum gap allowing electrons to be emitted, in the form of an electron beam, from the cathode to the anode target. During the releasing of the electrons, a filament contained within the cathode is heated to incandescence by passing an electric current therein. The electrons are accelerated by the high voltage potential and impinge on the target, whereby they are abruptly slowed down to emit x-rays. The high voltage potential generates a large amount of heat within the x-ray tube, especially within the anode.

Typically, a small portion of energy within the electron beam is converted into x-rays; the remaining electron beam energy is converted into thermal energy within the anode. The thermal energy radiates to other components within a vacuum vessel of the x-ray tube and is removed from the vacuum vessel via a cooling fluid circulating over an exterior surface of the vacuum vessel. Additionally, electrons within the electron beam are back-scattered from the anode and impinge on other components within the vacuum vessel, causing additional heating of the x-ray tube. As a result, the x-ray tube components are subject to high thermal stresses decreasing component life and reliability of the x-ray tube.

The vacuum vessel is typically enclosed in a casing filled with circulating, cooling fluid, such as dielectric oil. The casing supports and protects the x-ray tube and provides for attachment to a computed tomography (CT) system gantry or other structure. Also, the casing is lined with lead to provide stray radiation shielding. The cooling fluid often performs two duties: cooling the vacuum vessel, and providing high voltage insulation between the anode and cathode connections in the bi-polar configuration.

High temperatures at an interface between the vacuum vessel and a transmissive window in the casing cause the cooling fluid to boil, which may degrade the performance of the cooling fluid. Bubbles may form within the fluid and cause high voltage arcing across the fluid, thus degrading the insulating ability of the fluid. Further, the bubbles may lead to image artifacts, resulting in low quality images.

Prior art cooling methods have primarily relied on quickly dissipating thermal energy by using a circulating, coolant fluid within structures contained in the vacuum vessel. The coolant fluid is often a special fluid for use within the vacuum vessel, as opposed to the cooling fluid that circulates about the external surface of the vacuum vessel. Other methods have been proposed to electromagnetically deflect back-scattered electrons so that they do not impinge on the x-ray window.

These approaches, however, are limited with regard to energy storage and dissipation. Due to inherent poor efficiency of x-ray generation and desire for increased x-ray flux, heat load is increased that must be dissipated. As power of x-ray tubes continues to increase, heat transfer rate to the coolant can exceed heat flux absorbing capabilities of the traditional cooling system design.

A thermal energy storage device or electron collector, coupled to an x-ray window, has been used to collect back scattered electrons between the cathode and the anode. In using this device, the collector and window need to be properly cooled to prevent high temperature and thermal stresses, which can damage the window and joints between the window and collector.

High temperature on the window and collector can induce boiling of coolant. Bubbles from boiling coolant obscure the window and thereby compromise image quality. Further boiling of the coolant results in chemical breakdown of the coolant and sludge formation on the window, which also results in poor image quality.

Previously, a heat exchange chamber has been coupled to the electron collector, including a cooling channel, which allows coolant to flow in the channel across each of four walls of the electron collector. Although, the heat exchange chamber aids in cooling the electron collector, it is difficult to effectively manufacture due to its complexity and large number of seams, which each need to be properly sealed. Also, the heat exchange chamber has limited effectiveness in cooling of and preventing deposits from forming on the x-ray tube window. Also, portions of the window have been known to crack due to cyclic thermal loadings.

It would therefore be desirable to provide an apparatus and method of cooling an x-ray tube or x-ray tube window, that allows for increased scanning speed and power, that is relatively easy to manufacture, and that minimizes blurring and artifacts in a reconstructed image.

SUMMARY OF INVENTION

A slotted collector for an imaging system having a cathode and an anode includes an anode side, a cathode side opposing the anode side, and a common window side. Defined in the anode side is a cooling slot, and further defined is an internal bore through which electrons from the anode pass. The anode side also defines an anode receiving area such that a typical rotating anode may be positioned adjacent the collector such that maximum flux is directed through the internal bore and toward a cathode.

The cathode side further defines the internal bore such that the cathode is positioned near or inside of the internal bore for receiving electrons.

The window side is common to both the opposing cathode and anode sides. The window side includes a window and defines a fin pack area for receiving a fin pack. A window aperture extends between the window and the internal bore.

The slot defined within the anode side is further defined within the collector circumferentially along the window to reduce the thermal gradient across the window and reduce plastic strain in the window braze region. The slot is embodied as extending trans-axial to, intersecting the window aperture and extending beyond the aperture for a set length. Positioning of the slot is such that the heat from the back-scattered electrons flows through the area near the back of the fin-pack for dissipation. The slot also causes thermal isolation to reduce the temperature of the window aperture.

The present invention has several advantages over existing x-ray tube cooling systems. One of several advantages of the present invention is that it provides a path to force the heat flex to flow more closely to the liquid cooled fin-back area to increase cooling efficiency. Another advantage of the present invention is that it relieves plastic strain on the window attachment.

The present invention itself, together with attendant advantages, will be best understood by reference to the following detailed description, taken in conjunction with the accompanying figures.

BRIEF DESCRIPTION OF DRAWINGS

For a more complete understanding of this invention reference should now be had to the embodiments illustrated in greater detail in the accompanying figures and described below by way of examples of the invention wherein.

DETAILED DESCRIPTION

While the present invention is described with respect to an assembly for cooling an x-ray tube window within a computed tomography (CT) imaging system, the following apparatus and method is capable of being adapted for various purposes and is not limited to the following applications: MRI systems, CT systems, radiotherapy systems, flouroscopy systems, x-ray imaging systems, ultrasound systems, vascular imaging systems, nuclear imaging systems, magnetic resonance spectroscopy systems, and other applications known in the art.

In the following description, various operating parameters and components are described for one constructed embodiment. These specific parameters and components are included as examples and are not meant to be limiting.

Also, in the following description the term "impinge" refers to an object colliding directly with another object. For example, as known in the art, an electron beam impinges upon a target of an anode within an x-ray tube. The electron beam is directed at the target and electrons within the beam collide with the target.

Figure 1:
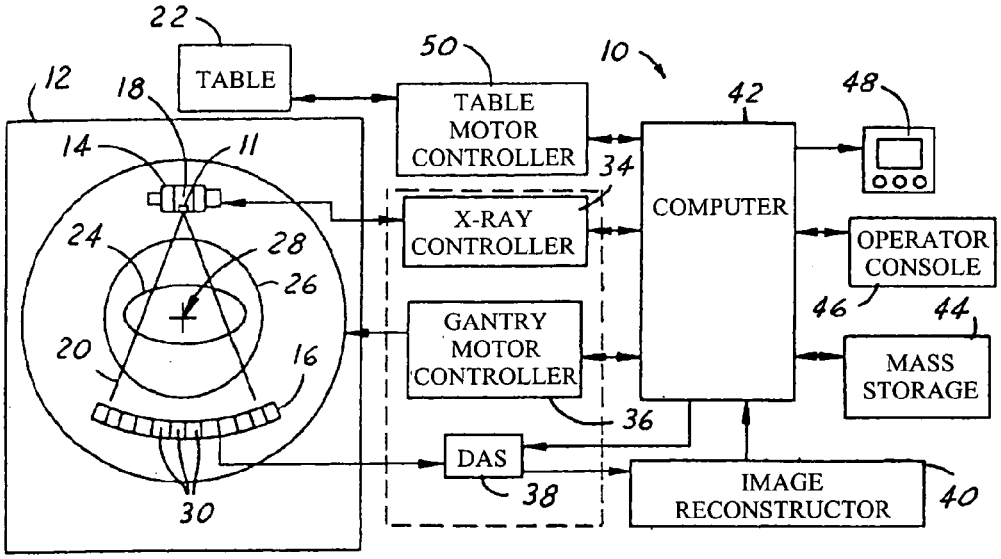
FIG. 1 is a block diagrammatic view of a multi-slice CT imaging system utilizing a slotted window collector assembly in accordance with an embodiment of the present invention.

Referring now to FIG. 1, a block diagrammatic view of a multi-slice CT imaging system 10 utilizing a slotted collector assembly 11 in accordance with one embodiment of the present invention is illustrated. The slotted collector assembly 11 will be further discussed regarding FIGS. 2–7.

The imaging system 10 includes a gantry 12 that has an x-ray tube assembly 14 and a detector array 16. The x-ray tube assembly 14 has an x-ray generating device or x-ray tube 18. The tube 18 projects a beam of x-rays 20 towards the detector array 16. The tube 18 and the detector array 16 rotate about an operably translatable table 22. The table 22 is translated along a z-axis between the assembly 14 and the detector array 16 to perform a helical scan. The beam 20 after passing through a medical patient 24, within a patient bore 26, is detected at the detector array 16 to generate projection data that is used to generate a CT image.

The tube 18 and the detector array 16 rotate about a center axis 28. The beam 20 is received by multiple detector elements 30. Each detector element 30 generates an electrical signal corresponding to intensity of an impinging x-ray beam. As the beam 20 passes through the patient 24 the beam 20 is attenuated. Rotation of gantry 12 and the operation of tube 18 are governed by a control mechanism 32. Control mechanism 32 includes an x-ray controller 34 that provides power and timing signals to the tube 18 and a gantry motor controller 36 that controls the rotational speed and position of gantry 12. A data acquisition system (DAS) 38 samples analog data from the detector elements 30 and converts the analog data to digital signals for subsequent processing. An image reconstructor 40 receives sampled and digitized x-ray data from the DAS 38 and performs high-speed image reconstruction. A main controller or computer 42 stores the CT image in a mass storage device 44.

The computer 42 may also receive commands and scanning parameters from an operator via an operator console 46. A consol 48 allows the operator to observe the reconstructed image and other data from the computer 42. The operator supplied commands and parameters are used by the computer 42 in operation of the DAS 38, the x-ray controller 34, and the gantry motor controller 36. In addition, the computer 42 operates a table motor controller 50, which translates the table 22 to position patient 24 in gantry 12.

The x-ray controller 34, the gantry motor controller 36, the image reconstructor 40, the computer 42, and the table motor controller 50 are preferably microprocessor-based such as a computer having a central processing unit, memory (RAM and/or ROM), and associated input and output buses. The x-ray controller 34, the gantry motor controller 36, the image reconstructor 40, the computer 42, and the table motor controller 50 may be a portion of a central control unit or may each be stand-alone components as illustrated.

Figure 2:
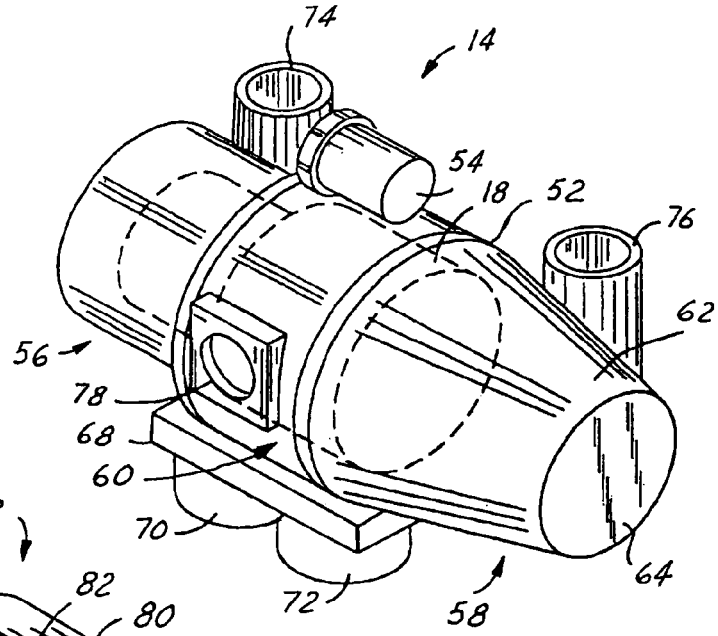
FIG. 2 is a perspective view of an x-ray tube assembly incorporating the slotted window collector assembly in accordance with an embodiment of the present invention.

Referring now to FIG. 2, a perspective view of the x-ray tube assembly 14 incorporating the slotted window collector assembly 11, in accordance with one embodiment of the present invention, is illustrated. The tube assembly 14 includes a housing unit 52 and may include a coolant pump 54, an anode end 56, a cathode end 58, and a center section 60 positioned between the anode end 56 and cathode end 58, which contains the x-ray tube 18. The x-ray tube 18 is enclosed in a fluid chamber 62 within lead-lined casing 64. The chamber 62 is typically filled with fluid, such as dielectric oil, but other fluids including water or air may be utilized. The fluid circulates through housing 52 to cool the x-ray tube 18 and may insulate casing 64 from high electrical charges within the x-ray tube 18.

Figure 3:
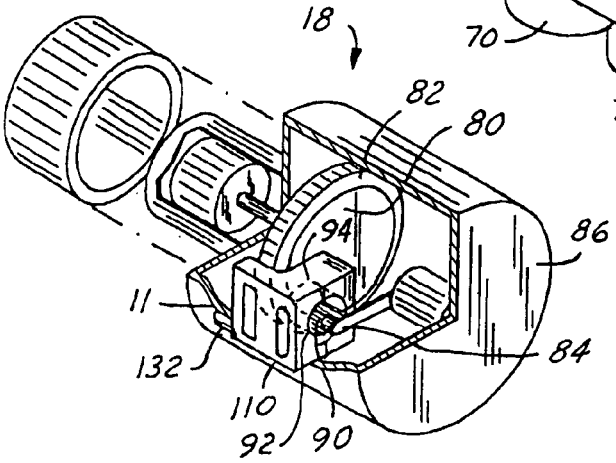
FIG. 3 is a sectional perspective view of an x-ray tube incorporating the slotted window collector assembly in accordance with an embodiment of the present invention.

Referring now to FIGS. 2 and 3, sectional perspective views of the x-ray tube 18 incorporating the slotted window collector assembly 11 in accordance with an embodiment of the present invention is illustrated. The x-ray tube 18 includes a rotating anode 80, having a target 82, and a cathode assembly 84 disposed in a vacuum within vessel 86.

The slotted window collector assembly 11 is interposed between the anode 80 and the cathode 84.

Figure 4:
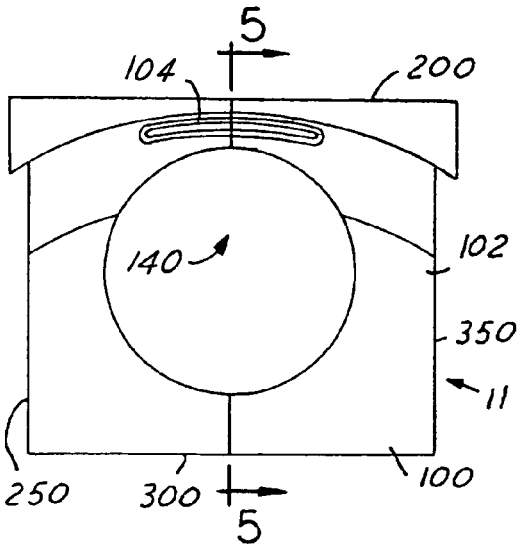
FIG. 4 is a close-up sectional perspective view of the slotted window collector assembly in accordance with an embodiment of the present invention.
Figure 5:
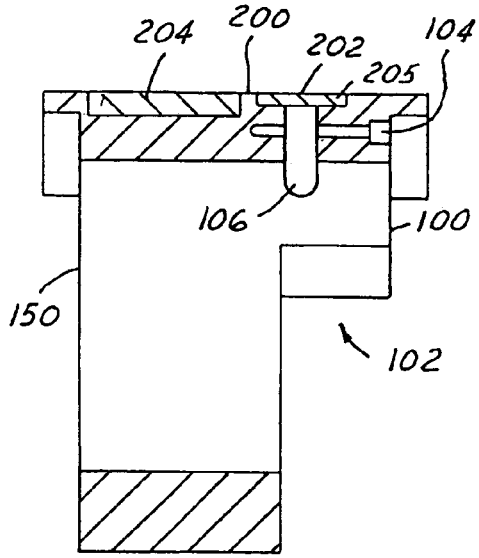
FIG. 5 is a view of the slotted window collector assembly looking in the direction of line 5—5 of FIG. 4.
Figure 6:
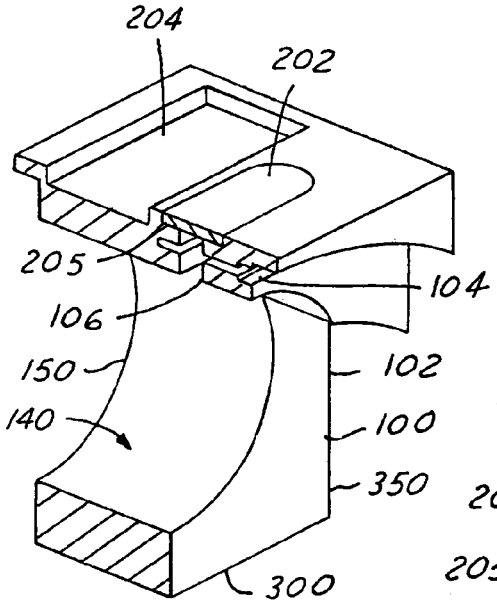
FIG. 6 is a top perspective view of half of the slotted window collector assembly of FIG. 4.
Figure 7:
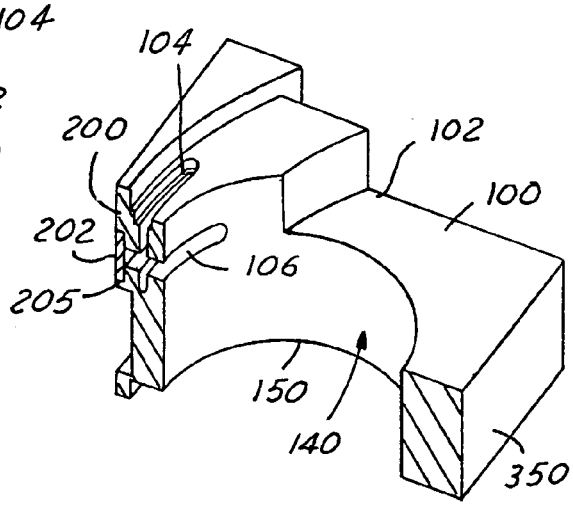
FIG. 7 is a side perspective view of half of the slotted window collector assembly of FIG. 4.

Referring now to FIGS. 4–7, the slotted window collector assembly 11 is illustrated. FIG. 4 is a close-up sectional perspective view of the slotted window collector assembly; FIG. 5 is a view of the slotted window collector assembly looking in the direction of line 5—5 of FIG. 4; FIG. 6 is a top perspective view of half of the slotted window collector assembly of FIG. 4; and FIG. 7 is a side perspective view of half of the slotted window collector assembly of FIG. 4.

As is illustrated, the collector 11 includes an anode side 100, a cathode side 150 opposing said anode side 100, an internal bore 140 defined between said anode side 100 and said cathode side 150, and a window side 200 common to both said anode side 100 and said cathode side 150. The present embodiment of the collector 11 is cubical in shape and also includes three other sides 250, 300, 350 common to both the anode side 100 and the cathode side 150.

As was mentioned, the collector 11 includes an anode side 100 having an anode receiving area 102. The anode side 100 defines the anode receiving area such that a typical rotating anode may be positioned adjacent to the collector 11 such that maximum flux reflected from the anode 82 is directed through the internal bore 140 and toward the cathode 84. One embodiment of the present invention includes the slot 104 extending through the anode side 100. Also defined in the anode side 100 is a bore 106 through which electrons from the anode 82 pass, as will be understood by one skilled in the art.

The cathode side 150 further defines the internal bore 140 such that the cathode 84 is positioned near or inside of the internal bore 140 to receive electrons.

The window side 200 is common to both the opposing cathode and anode sides 100, 150. The window side 200 includes a window 202 and defines a fin pack area 204 for receiving a fin pack and cooling the anode 84. One skilled in the art will realize that a window aperture 106 extends between the window 202 and the internal bore 140.

The slot 104 is defined within the collector 11 circumferentially along the window 202 to reduce the thermal gradient across the window 202 and reduce plastic strain in the window braze region. The slot 104 is embodied as extending trans-axial to, intersecting and extending beyond the window aperture 106. Positioning of the slot 104 is such that the heat from the anode 82 flows through the internal bore 140 and then along the slot 104 prior to flowing to the window 202 (i.e. the slot 104 generates thermal isolation). The window temperatures are decreased significantly as a result of the slotted design.

The slot 104 adds flexibility to the collector system 10 and mechanically isolates the window braze joint 205 from the non symmetric heat load and associated thermal growth of the collector system, thereby reducing the plastic strain in the window attachment joint.

The slot 104 further has allowed a wider internal bore 140, reducing the material required in the collector and simplifying the manufacture of the assembly, due to the decrease in temperature of the window.

In operation, an electron beam 90 is directed through central cavity 92 and accelerated toward the anode 80. The electron beam 90 impinges upon a focal spot 94 on the target 82 and generates high frequency electromagnetic waves or x-rays and residual energy. The residual energy is absorbed by components within the x-ray tube 18. x-rays are directed through the vacuum toward the window aperture 106 in slotted window collector assembly 11.

The residual energy includes radiant thermal energy from the anode 80 and kinetic energy from back scattered electrons that deflect off the anode 80. The kinetic energy is converted into thermal energy upon impact with components in the vessel 86. A portion of the kinetic energy is reduced by the slotted window collector assembly 11 because of the increased surface area over which the kinetic energy flows.

Disposed at the exterior of the aperture 106 is the x-ray tube window 202, formed of a material that efficiently allows passage of x-rays. The window 202 is hermetically sealed to slotted window collector assembly 11 at seal 205, such as by vacuum brazing or welding. Seal 205 serves to maintain the vacuum within vessel 86. Thus, x-ray tube 18 generates residual energy and x-rays that are directed out of the x-ray tube 18 through the window 202.

In operation, a method of operating the x-ray tube 18 in accordance with an embodiment of the present invention is illustrated. The electron beam is generated as stated above and is directed to impinge upon the target anode 82 as to generate the x-rays.

The x-rays are directed through the window 202, which increases temperature of the window 202. Back-scattered electrons, from the electron beam, are also impinging upon the window 202 further increasing temperature of the window 202. Heat from the anode 82 on the window 202 is reduced however because the heat must now flow around the increased surface area of said slot 104 and is directed toward the cooling fins.

The above-described steps are meant to be an illustrative example; the steps may be performed synchronously or in a different order depending upon the application.

The present invention provides an x-ray generating device window cooling system that provides improved cooling and is relatively simple to manufacture. The window is efficiently cooled, thus minimizing blurring and artifacts in a reconstructed image.

The above-described apparatus and method, to one skilled in the art, is capable of being adapted for various applications and systems known in the art. The above-described invention can also be varied without deviating from the true scope of the invention.

What is claimed is:

1. A collector assembly for an x-ray tube having an anode and a cathode comprising:

an anode side;

a cathode side opposing said anode side, said anode side and said cathode side defining an internal bore there between;

a window side common to both said anode side and said cathode side, said window side defining a window area thereon, a window aperture is defined extending from said window area to said internal bore, and a slot is defined within the collector assembly intersecting said window aperture.

2. The collector assembly of claim 1 further comprising a window coupled to said window area.

3. The collector assembly of claim 2, wherein said slot extends circumferentially along at least one of said window or said window area.

4. The collector assembly of claim 1, wherein said slot extends trans-axial to said window aperture and beyond.

5. The collector assembly of claim 1, wherein the collector is cubical in shape and comprises three other sides common to both said anode side and said cathode side.

6. The collector assembly of claim 1, wherein said anode side defines a receiving area for the anode.

7. The collector assembly of claim 1, wherein said slot is defined within the collector assembly intersecting said window aperture such that at least one of direction of bending stiffness on said window area or heat dissipated through said window area is reduced.

8. The collector assembly of claim 1, wherein said slot is defined within said collector assembly at least one of an offset from said window area, aligned with said window area, different in surface area than said window area, having a same surface area to said window area, or having a differing shape than said window area.

9. A collector assembly for an x-ray tube comprising:

an anode side;

a cathode side opposing said anode side, said anode side and said cathode side defining an internal bore therebetween for receiving x-rays from an anode, said anode side further defining a slot;

a window side common to both said anode side and said cathode side, said window side comprising a window coupled thereto, wherein a window aperture is defined extending from said window to said internal bore, and wherein said slot is further defined within the collector assembly trans-axial to said window aperture and beyond, said slot defined opening into said anode side between said bore and said window side, and said slot extending circumferentially along said window such that at least one of plastic strain on said window or heat on said window is reduced.

10. The collector assembly of claim 9, wherein the collector is cubical in shape and comprises three other sides common to both said anode side and said cathode side.

11. The collector assembly of claim 9, wherein said anode side defines a receiving area for an anode.

12. An x-ray tube comprising:

a housing unit;

a cathode coupled within said housing unit and generating an electron beam;

an anode coupled within said housing unit and receiving said electron beam and generating x-rays directed through an x-ray tube window; and a slotted collector assembly coupled to said x-ray tube window and comprising an anode side, a cathode side opposing said anode side, said anode side and said cathode side defining an internal bore therebetween, a window side common to both said anode side and said cathode side, said window side defining a window area therein, said x-ray tube window couples to said window area, a window aperture is defined extending perpendicularly from said window area to said internal bore, and a slot is defined within the collector assembly intersecting said window aperture such that at least one of plastic strain on said x-ray tube window or heat in said x-ray tube window is reduced.

13. The collector assembly of claim 12, wherein said slot is defined within said collector assembly at least one of an offset from said window area, aligned with said window area, different in surface area than said window area, having a same surface area to said window area, or having a differing shape than said window area.

14. An x-ray tube as in claim 12, wherein said slotted collector assembly is interposed between said cathode and said anode.

15. An x-ray tube as in claim 12, wherein said slotted collector assembly further comprises a fin pocket coupled to said window side.

16. An x-ray tube as in claim 12, wherein said slot extends circumferentially along at least one of said x-ray tube window or said window area.

17. An x-ray tube as in claim 12, wherein said slot extends trans-axial to said window aperture.

18. An x-ray tube as in claim 12, wherein the collector is cubical in shape and comprises three other sides common to both said anode side and said cathode side.

19. An x-ray tube as in claim 12, wherein said anode side defines a receiving area for an anode.

* * * * *